United States Patent [19]

Mäntymäki

[11] Patent Number: 4,530,311

[45] Date of Patent: Jul. 23, 1985

[54] WASTE HEAT BOILER CONSTRUCTION

[75] Inventor: Tarmo K. Mäntymäki, Merstola, Finland

[73] Assignee: Outokumpu Oy, Helsinki, Finland

[21] Appl. No.: 473,363

[22] Filed: Mar. 8, 1983

[30] Foreign Application Priority Data

Mar. 18, 1982 [FI] Finland ..... 820942

[51] Int. Cl.[3] ..... F22D 7/00

[52] U.S. Cl. ..... 122/7 R; 122/235 N; 122/420; 122/421

[58] Field of Search ..... 122/7 R, 7 A, 7 C, 7 D, 122/223, 225 R, 226, 227, 228, 412, 420, 421, 470, 379, 235 A, 235 N; 110/119, 165 R, 234; 75/92

[56] References Cited

U.S. PATENT DOCUMENTS

| | | | |
|---|---|---|---|
| 2,550,676 | 5/1951 | Dalin | 122/7 C |
| 3,314,231 | 4/1967 | Hochmuth | 122/7 R |
| 3,583,369 | 6/1971 | Petry | 122/7 R |
| 4,027,602 | 6/1977 | Mott | 110/234 |
| 4,088,310 | 5/1978 | Noponen et al. | 75/92 |
| 4,180,019 | 12/1979 | O'Sullivan et al. | 122/235 N |
| 4,262,636 | 4/1981 | Augsberger | 122/7 R |
| 4,270,493 | 6/1981 | Blaskowski | 122/7 R |

FOREIGN PATENT DOCUMENTS

| | | | |
|---|---|---|---|
| 1211656 | 3/1966 | Fed. Rep. of Germany | 122/421 |

*Primary Examiner*—Henry C. Yuen
*Assistant Examiner*—Steven E. Warner
*Attorney, Agent, or Firm*—John Smith-Hill

[57] ABSTRACT

The present invention relates to a waste heat boiler construction where the convection chamber (5) of the waste heat boiler is located on essentially lower level than the radiation chamber (2). In order to lower the end of the radiation chamber (2) gradually onto the level of the convection chamber (2), into the radiation chamber are placed walls (1) essentially in transversal direction to the gas flow, which walls at the same time divide the radiation chamber into separate sections. In order to profitably conduct the gas flow in the radiation chamber, the roof of the radiation chamber (2) is provided with panels (3) located in the gas flow direction, so that the gas flows from the previous section are divided roughly into two by means of the panels (3) of the following section.

3 Claims, 2 Drawing Figures

WASTE HEAT BOILER CONSTRUCTION

Figure 1:
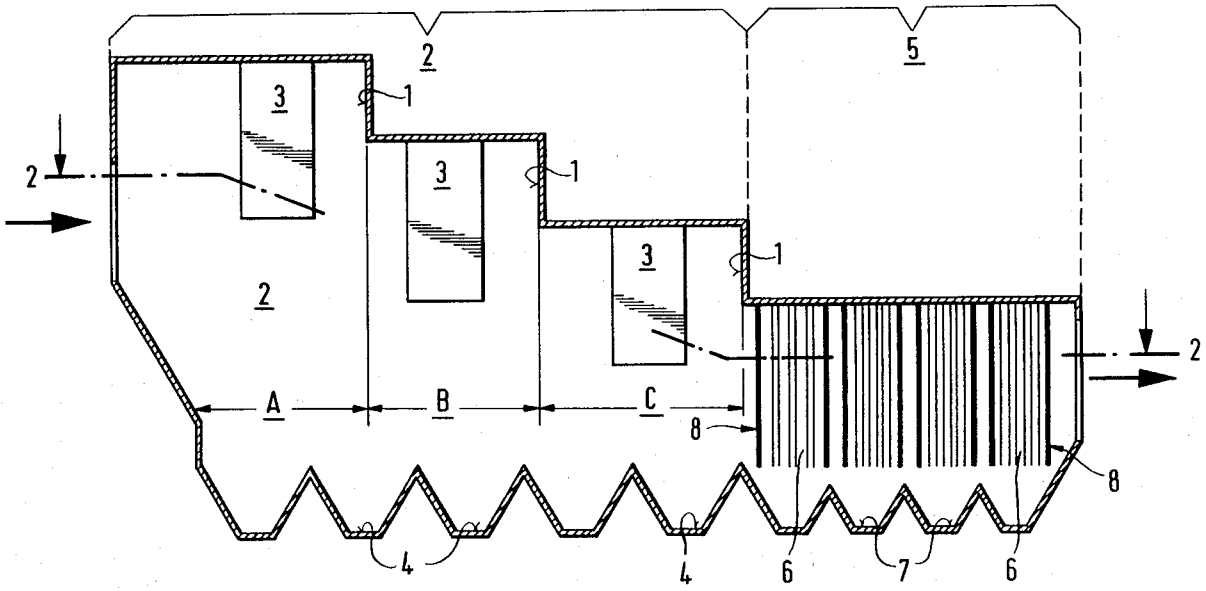

The present invention relates to a waste heat boiler construction which is provided in connection with a suspension smelting furnace, and wherein the dust-bearing gases created in the suspension smelting furnace are prevented from flowing directly from the radiation chamber of the waste heat boiler into its convection chamber in order to diminish the formation of dust accretions within the boiler and in order to profitably utilize the total volume thereof.

The general type of waste-heat boiler provided in connection with a suspension smelting furnace is a so-called tunnel-type boiler operated with direct gas flow, which boiler is divided into two chambers, i.e. the radiation chamber and the convection chamber. The purpose of the radiation chamber is to cool the gases so that the molten particles contained in the gas are solidified and the temperature decreases below the sintering temperature of the particles before the gases are conducted into the convection chamber of the boiler. In the convection chamber the final heat contained by the dust-bearing gases is recovered by means of a cooling pipework.

A drawback of tunnel-type waste heat boilers is the formation of dust accretions owing to the high dust-content of the gases created in the suspension smelting, and these dust accretions are an obstruction for effective operation of the waste heat boiler, as well as for the suspension smelting process on the whole. These operation difficulties may cause production breaks in suspension smelting processes and thus result in great economical losses for the producer. Among the factors which enhance the tendency for dust accretions can be mentioned the following:

Only the roof and the upper parts of the walls of the waste heat boiler are in effective use—presupposing that they are clean. Because a major part of the heat load is focused on a small area of the boiler, it is difficult to keep the waste heat boiler clean. Moreover, the hot, dust-bearing gases flow partly uncooled directly into the convection chamber of the boiler, which causes the molten dust particles to stick onto the cooling pipework, and the cooled particles to sinter. In addition to this, the lower part of the waste heat boiler receives radiation ineffectively but allows a certain amount of the dust-bearing gas to remain for a considerably long time in the boiler, which creates conditions for the formation of harmful sulphate. The formation of sulphate can, owing to the moisture contained in the gases and/or possible boiler leakages, lead to the creation of sulphuric acid, which corrodes the boiler equipment. It is also pointed out that as the boiler size grows, the difficulties created by dust accretions grow alike.

In prior art many different methods have been tried in order to eliminate dust accretions in waste heat boilers; for example, the cleaning of the boiler has been made easier by means of rapping devices, which has had a positive effect—but only in eliminating the symptoms, not in eliminating the reason. The drawbacks of an excessively effective application of this method will soon be seen as the service life of the waste heat boiler is shortened. Within the radiation chamber of the waste heat boiler there have been provided cooling panels in the flowing direction of the gas; these panels are known to work well, if they are correctly designed. Experiments have also been carried out by providing in the radiation chamber of the waste heat boiler cooling panels disposed transversely to the gas flow direction, but experiences from these are mainly unfavorable. It has also been tried to prevent the gas from flowing directly on along the roof of the radiation chamber by arranging so that the convection chamber has been placed lower than the radiation chamber, in which case the far end of the radiation chamber is slanted downwards.

The purpose of the waste heat boiler construction introduced in the present invention is to eliminate the drawbacks of the above described prior art constructions and to achieve a waste heat boiler, suited for the cooling of dust-bearing gases created in suspension smelting processes, which is better and safer in operation than the prior art waste heat boilers.

According to the present invention, the convection chamber of the waste heat boiler is placed on essentially lower level than the initial part of the radiation chamber, in order to prevent the dust-bearing gases from flowing directly on along the roof of the radiation chamber. The roof of the radiation chamber is constructed so that the radiation chamber descends gradually down to the level of the initial end of the convection chamber. This is achieved by employing at least one auxiliary wall placed transverse of the gas flow direction, which wall is kept clean by providing it with rapping devices, which may be of known type. When the direct flow of the dust-bearing gases along the roof of the radiation chamber is thus prevented, it is possible to utilize the bottom part of the radiation chamber, which has remained ineffective in prior art constructions. Now also the heat transfer area grows, and both the cooling and the cleaning of the gases takes place more rapidly than before.

According to the invention, in order to profitably direct the flow of dust-bearing gases from the radiation chamber into the convection chamber, additional panels are mounted to the roof of the radiation chamber in the gas flow direction, so that in each section formed by the transversal walls of the radiation chamber, the panel of the following section divides the gas flows from the previous section roughly into two equal parts. Thus the number of panels in each section grows towards the end of the radiation chamber, and the gas flow is directed evenly towards the opening between the radiation chamber and the convection chamber-preferably so that is passes near the side walls of the radiation chamber, because the amount of molten particles contained in the gases, as well as their tendency to form accretions on the boiler walls, are essentially diminished owing to the quicker cooling and cleaning of the gases.

Consequently, the construction of the invention can be employed for easier and more effective processing of greater amounts of dust-bearing gas than in nominally equal-sized prior art waste heat boiler constructions, which in part reduces the production and operation costs of both the waste heat boiler itself and of the whole smelting unit.

Figure 2:
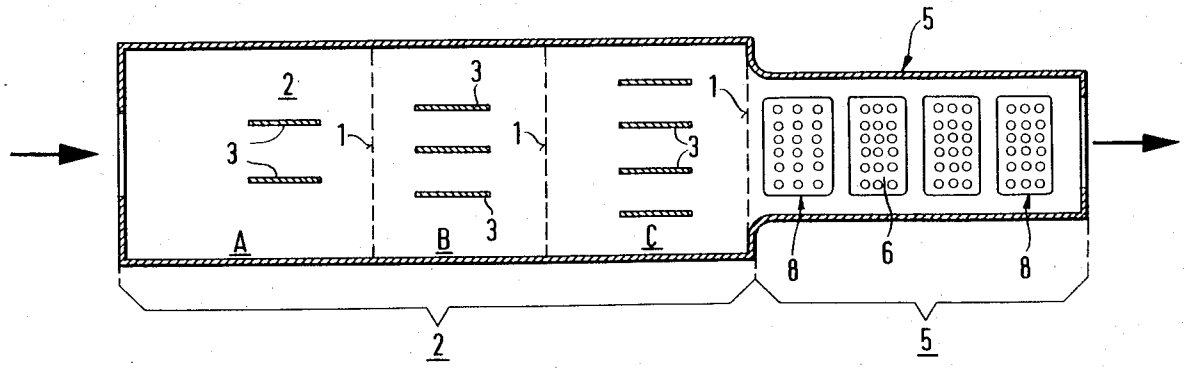

In the following the invention is explained in more detail with reference to the appended drawing, where FIG. 1 is a schematical illustration of a preferred embodiment of the waste heat boiler construction of the present invention in side elevation view and in vertical cross-section, and FIG. 2 is an illustration of the preferred embodiment of the waste heat boiler construction of FIG. 1, seen from the top along the section 2—2 in FIG. 1.

The figures show three separate walls 1, which are transversal to the gas flow direction and form stepwise descending levels in the roof of the radiation chamber 2. In FIG. 2 the location of the walls 1 is marked by dotted lines. Depending on the power and operation conditions of the boiler arrangement, the number of these transversal walls can be for example only two, or as much as five. The most advantageous number of walls is chosen by taking into account all important factors in each case. In the figures the horizontal planes of each step are provided with panels 3 hanging from the roof. The number of these panels 3 is two in the section A, three in the following section B and four in the last section C. Thus the panels of the section B divide the gas flows coming from the previous section A roughly into two halves; similarly the panels of section C divide the gas flows from section B roughly into two halves.

If desired, the panels in the gas flow direction can be arranged in each section into two series, which are situated one after another in the roof of each section, in which case the panelgroups should be in the embodiment present in the figures in total six. Also in this case the panels 3 are arranged in order to divide the part between the panels roughly into two halves.

The final recovery of heat takes place in the convection chamber 5 of the waste heat boiler, where the gases enter after most of the solid impurities contained in the gases have been removed. These impurities fall into the funnel-shaped dust hoppers 4 located at the bottom of the radiation chamber 2 and can thereafter be removed. Similarly the solid substance stuck onto the panels 3 will finally end up at the bottom 4, because the panels 3 are provided with rapping devices of known type, which drop the gathered material down from time to time. The bottom of the convection chamber is also provided with funnel-shaped dust hoppers 7 in order to recover and to discharge such solid substances which are further separated from the gases. In the convection chamber the heat is recovered into the liquid circulating in the cooling pipework 6. In this particular embodiment the pipework 6 is divided into several units 8, which are separated from each other. The pipeworks 6 can also be constructed for total circulation in some previously known manner, as long as the heat-receiving area remains large enough in order to ensure effective recovery of heat. If desired, the area can be enlarged in a manner generally known in the boiler construction trade.

The gases blow out of the waste heat boiler are already rather clean, wherefore they can be conducted into an electrofilter for final cleaning before directing them for example into further processing.

We claim:

1. A waste heat boiler construction comprising a radiation chamber defining a first tunnel portion which has an inlet end and an outlet end and is bounded at its top by a roof, a convection chamber defining a second tunnel portion which has an inlet end and an outlet end and is bounded at its top by a roof, the first tunnel portion being connected at its outlet end to the inlet end of the second tunnel portion, and the roof of the second tunnel portion being lower than the roof of the first tunnel portion at the inlet end of the first tunnel portion, the roof of the first tunnel portion extending downwards from its inlet end towards the roof of the second tunnel portion in a plurality of steps defined by substantially vertical wall portions and substantially horizontal ceiling portions, said substantially vertical wall portions being disposed essentially transverse to the direction of flow of gas from the inlet end of the first tunnel portion towards the outlet end thereof.

2. A waste heat boiler construction according to claim 1, wherein each section of the first tunnel portion defined between two successive substantially vertical wall portions is provided with at least one row of plateform panels, the panels being disposed generally parallel to said direction of flow of gas and each row being disposed transversely of said direction.

3. A waste heat boiler construction according to claim 2, wherein there are at least three of said wall portions defining an upstream section and a downstream section, with respect to said direction of flow of gas, and the panels of the downstream section are so arranged as to divide the flow of gas from between two adjacent panels of the upstream section into two roughly equal parts.

* * * * *